US007497190B2

(12) United States Patent
Stephen

(10) Patent No.: US 7,497,190 B2
(45) Date of Patent: Mar. 3, 2009

(54) RESTRAINING APPARATUS

(75) Inventor: Elaine Stephen, Peterhead (GB)

(73) Assignee: Red Island Limited, Aberdeenshire (GB)

( * ) Notice: Subject to any disclaimer, the term of this patent is extended or adjusted under 35 U.S.C. 154(b) by 193 days.

(21) Appl. No.: 10/528,209

(22) PCT Filed: Sep. 22, 2003

(86) PCT No.: PCT/GB03/04159

§ 371 (c)(1),
(2), (4) Date: Mar. 16, 2005

(87) PCT Pub. No.: WO2004/028308

PCT Pub. Date: Apr. 8, 2004

(65) Prior Publication Data

US 2005/0255286 A1 Nov. 17, 2005

(30) Foreign Application Priority Data

Sep. 25, 2002 (GB) ..... 0222203.2

(51) Int. Cl.
*A62B 35/00* (2006.01)

(52) U.S. Cl. ..... 119/770; 119/795; 428/99

(58) Field of Classification Search ..... 428/99, 428/12; 119/770, 769, 795
See application file for complete search history.

(56) References Cited

U.S. PATENT DOCUMENTS

| | | | | |
|---|---|---|---|---|
| 725,579 | A * | 4/1903 | Morris | 119/758 |
| 1,924,596 | A | 9/1933 | Davis | |
| 2,275,983 | A * | 3/1942 | Nadeau | 119/770 |
| 3,563,208 | A | 2/1971 | Nero | |
| 4,220,328 | A * | 9/1980 | Crush, Jr. | 482/92 |
| 4,321,734 | A * | 3/1982 | Gandelman | 24/648 |
| 5,003,930 | A | 4/1991 | Shields | |
| 5,423,292 | A | 6/1995 | Hall | |
| D372,890 | S | 8/1996 | Ferm et al. | |
| D396,833 | S | 8/1998 | Eidt et al. | |
| D420,624 | S | 2/2000 | Gonzalez | |
| 6,047,665 | A | 4/2000 | Deveaux | |
| 6,422,176 | B1 | 7/2002 | Tonuzi | |
| 6,435,931 | B1 | 8/2002 | Yaeger et al. | |
| D479,164 | S | 9/2003 | Wu | |

FOREIGN PATENT DOCUMENTS

| | | |
|---|---|---|
| DE | 4142236 A | 6/1993 |
| FR | 2777435 A1 | 4/1988 |
| WO | WO 97/25858 | 7/1997 |

* cited by examiner

*Primary Examiner*—Alexander Thomas
(74) *Attorney, Agent, or Firm*—Drinker Biddle & Reath LLP

(57) ABSTRACT

Restraining apparatus for coupling together two or more users such as children while walking as a group. The apparatus comprises a spine member with lateral attachment arms for coupling the users to the spine member. The spine member is laterally flexible to allow the spine to bend from side to side when corners are being negotiated in use, but has sufficient stiffness in the vertical plane to resist sagging between the users.

18 Claims, 12 Drawing Sheets

RESTRAINING APPARATUS

This Application is the U.S. National Phase Application of PCT International Application No PCT/GB03/004159 filed Sep. 22, 2003. The present invention relates to restraining apparatus, and especially but not exclusively to apparatus for securing children.

DESCRIPTION OF THE RELATED ART

It is often difficult to control a group of children and to keep them safe in the group, particularly when taking them for walks or excursions.

BRIEF SUMMARY OF THE INVENTION

According to the present invention there is provided restraining apparatus for coupling two or more users comprising at least one spine member with at least two lateral attachment members for coupling the users to the spine member, the spine member having two planes, and having more flexibility in one plane than in the other.

The spine member can be an elongate rod or plate from which the lateral attachment members extend sideways. The rod or plate is typically inextensible along its long axis and is preferably rigid in its vertical plane but preferably has some lateral resilience, so that it can bend sideways in its horizontal plane with the movement of the users. Lateral resilience in the horizontal plane in use of the device is preferable to lateral resilience in the vertical planes because rigidity in the vertical plane with respect to the user has the benefit that parts of the spine member have a reduced tendency to sag and become trampled underfoot. Therefore, preferred embodiments of the device can bend laterally from side to side in the horizontal plane of the device, but not up and down in the vertical plane of the device.

In some embodiments the spine member is axially compressible and/or extensible. Plastics material is suitable for the spine members. Optionally, at least a part of the spine member is made of corrugated plastic. Alternatively, the spine member is made of composite plastics material or rubber. The spine may have a stiffening member, such as a plastics, metal or composite plate covered with the plastics or rubber material, to enhance rigidity in one plane.

The spine being flexible and/or compressible allows the users to approach each other and to turn corners.

Preferably, the attachment members are securely attached, but in a releasable manner and are typically coupled to the spine member at nodes on the spine member. Preferably, each node has two attachment members.

The attachment members are typically arms. The arms may be laterally flexible and/or axially extensible and/or compressible, to absorb sudden forces. In some embodiments they can be rigid or semi-rigid, or preferably non-flexible in some planes but flexible in others.

Typically, the attachment members are pivotable with respect to the spine member. Optionally, each attachment member at each node is pivotable with respect to the other attachment member. In preferred embodiments, each node has a pair of attachment members extending laterally from opposite sides of the spine member. It is not necessary to have an attachment member extending from each side of each node; a single node can instead bear a single attachment member. Attachment members can all extend from the same side of the spine member, or from different sides. In one optional embodiment, members are staggered along the spine member.

Pivotal attachment members allow users of different heights to share one node.

Optionally, two or more spine members are connected together.

This allows a long chain of spine members and nodes to be built up, which is useful to connect a large number of users.

Preferably, the apparatus also includes harnesses to be worn by each user. Typically, each harness is adapted to releasably engage an attachment member, to attach the user to the spine member. Typically, the harness includes a belt. Optionally, the harness includes a shoulder strap, but simple waist belts would suffice. Preferably, each harness has at least one socket to engage a protrusion on an attachment member, but other attachment formations can be used instead. Optionally, the socket includes a first plate, biased apart from and pivotable relative to a second plate, and pivoting moves the ends of the plates at the socket mouth apart to enlarge the mouth to engage/release an attachment member. Typically, the plates are biased apart by a coil spring. Typically, both plates are pivotable with respect to the socket. Another alternative attachment system could involve moulded plastic ball-joints and sockets, clips, buckles, or other similar connectors that are commercially available.

In another aspect the invention provides a method of securing or restraining a person, comprising harnessing the person to a spine member via an attachment member, the spine member having at least two planes, and having a different degree of flexibility in respective planes.

Typically more than one person is harnessed to the spine member.

In some embodiments the spine and/or the harness can be coloured brightly, and/or can incorporate luminous, reflective and/or light emitting devices such as LEDs and strobes to attract attention.

BRIEF DESCRIPTION OF THE DRAWINGS

An embodiment of the present invention will now be described by way of example only and with reference to the following drawings, in which:—

DETAILED DESCRIPTION OF THE INVENTION

Figure 1:
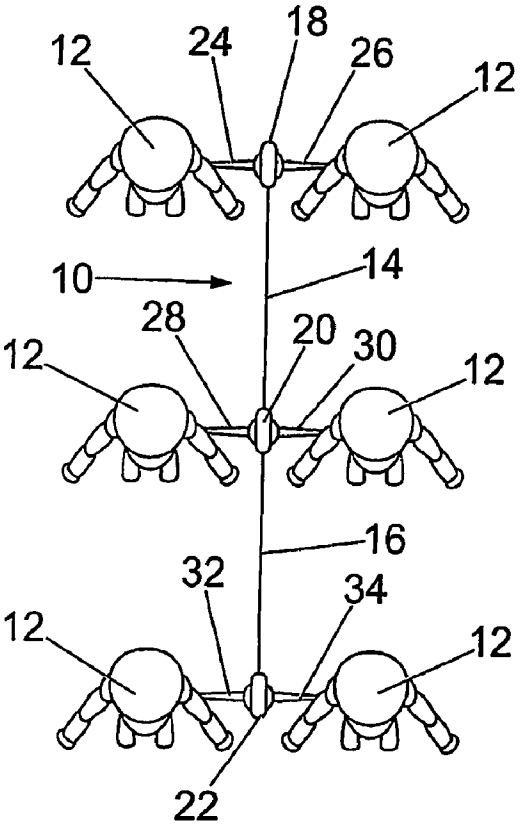
FIG. 1 is a plan view of six children using a restraining apparatus.

FIG. 1 shows six children 12 secured together by restraining apparatus 10. The apparatus 10 has two elongate spine members 14, 16. Each node 18, 20, 22 has two lateral arms 24, 26, 28, 30, and 32, 34.

Figure 3:
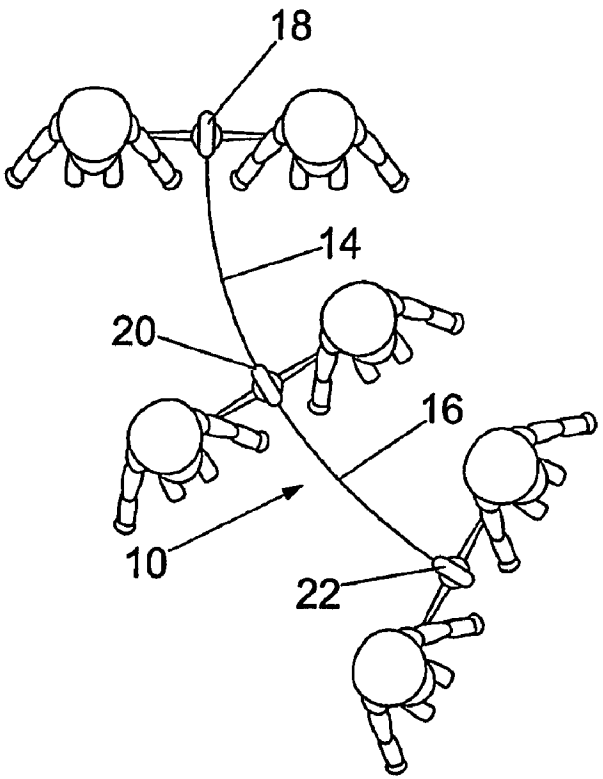
FIG. 3 is a plan view of the children in a curved configuration.
Figure 2:
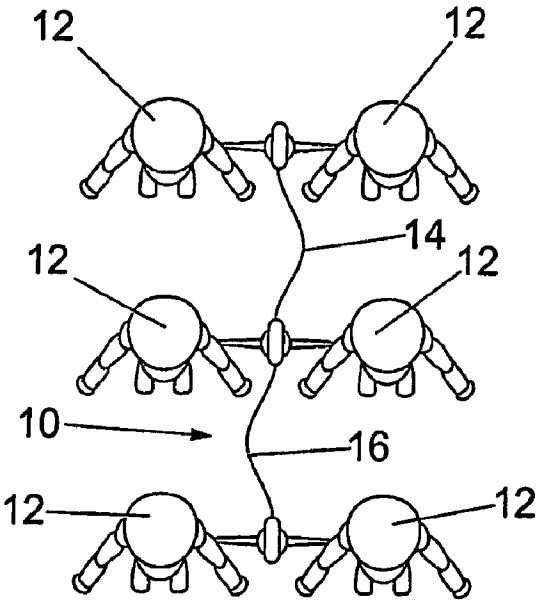
FIG. 2 is a plan view with the children with the apparatus in a compressed position.

The spine members 14, 16 are optionally axially compressible and/or extensible and/or laterally flexible in the horizontal plane of the apparatus in use, to allow the apparatus to bend. This allows the children 12 to approach each other (FIG. 2) and turn corners (FIG. 3). However, the spine members 14, 16 are normally inextensible, or at least only very slightly axially resilient, so that the distance between the children cannot increase to any great extent. Also, the spine members are typically comparatively more rigid in the vertical plane than in the horizontal plane, so that the spine does not sag between nodes.

Different sizes of apparatus 10 are envisaged, depending on the number of children to be secured. To make a larger version of apparatus 10, additional spine members and nodes can simply be attached to the apparatus 10.

Figure 4:
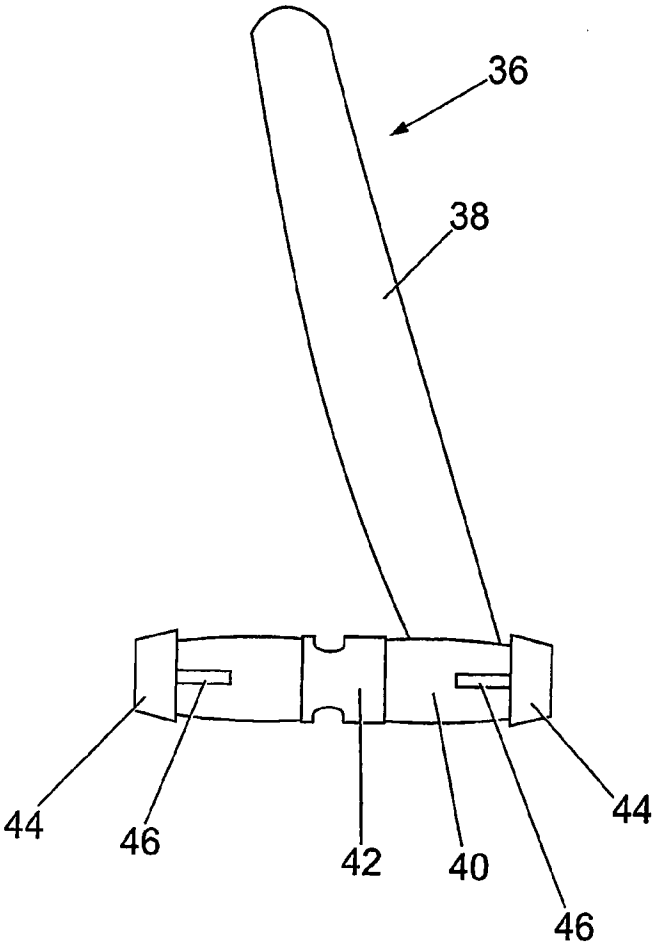
FIG. 4 is a front view of a harness worn by each child.

FIG. 4 shows a harness 36 that is used to attach the children 12 to the apparatus 10. The harness 36 has a shoulder strap 38 and a belt 40. The belt 40 is fastened by a simple buckle 42. The belt 40 also has two sockets 44 for engagement with an arm of the apparatus 10. Sockets 44 can optionally slide on rails 46 provided in the belt, so that the child can turn sideways with respect to the spine 14, 16. The sockets 44 can typically be switched between a first configuration where they are fixed immovably to the rails 46, and a second configuration in which they can slide relative to the rails 46.

Figure 5:
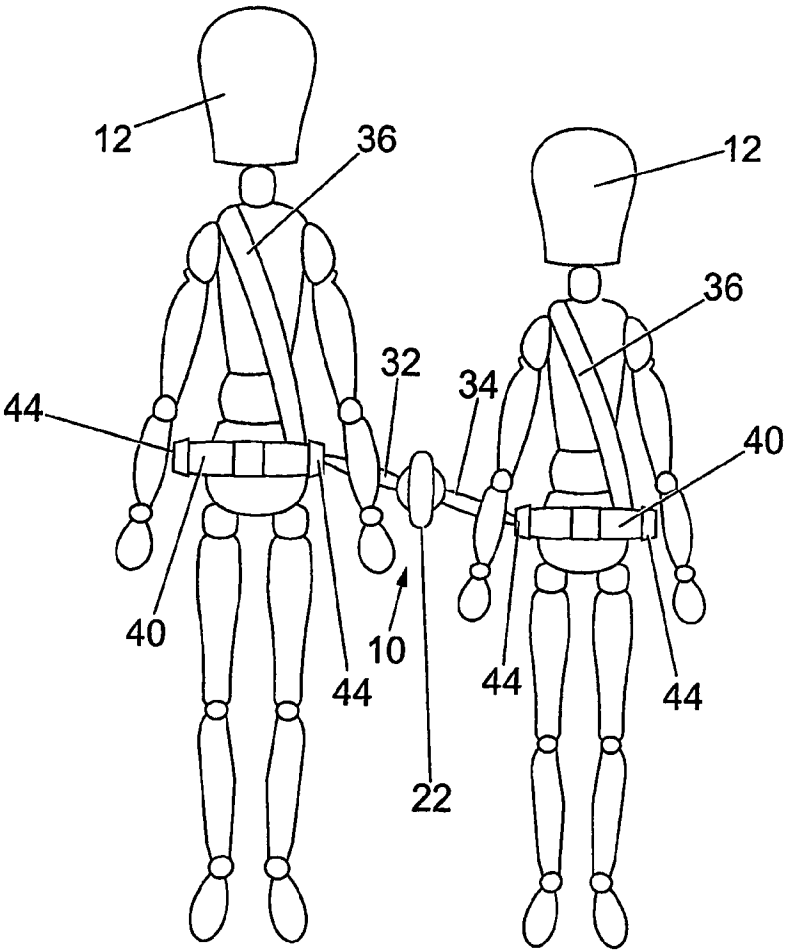
FIG. 5 is a front view of the apparatus worn by two children of different heights.

FIG. 5 shows two different-sized children 12 secured to node 22 by arms 32, 34. Each user 12 is wearing a harness 36, and a socket 44 in each harness 36 is engaged with an arm 32, 34 of the node 22. The arms 32, 34 are pivotable with respect to the node 22, to allow the different-sized children 12 to be connected to the apparatus 10 without twisting the apparatus 10.

The arms 32, 34 can also be axially and laterally resilient so as to resist the transfer of forces between the children connected to the node 22.

Figure 6:
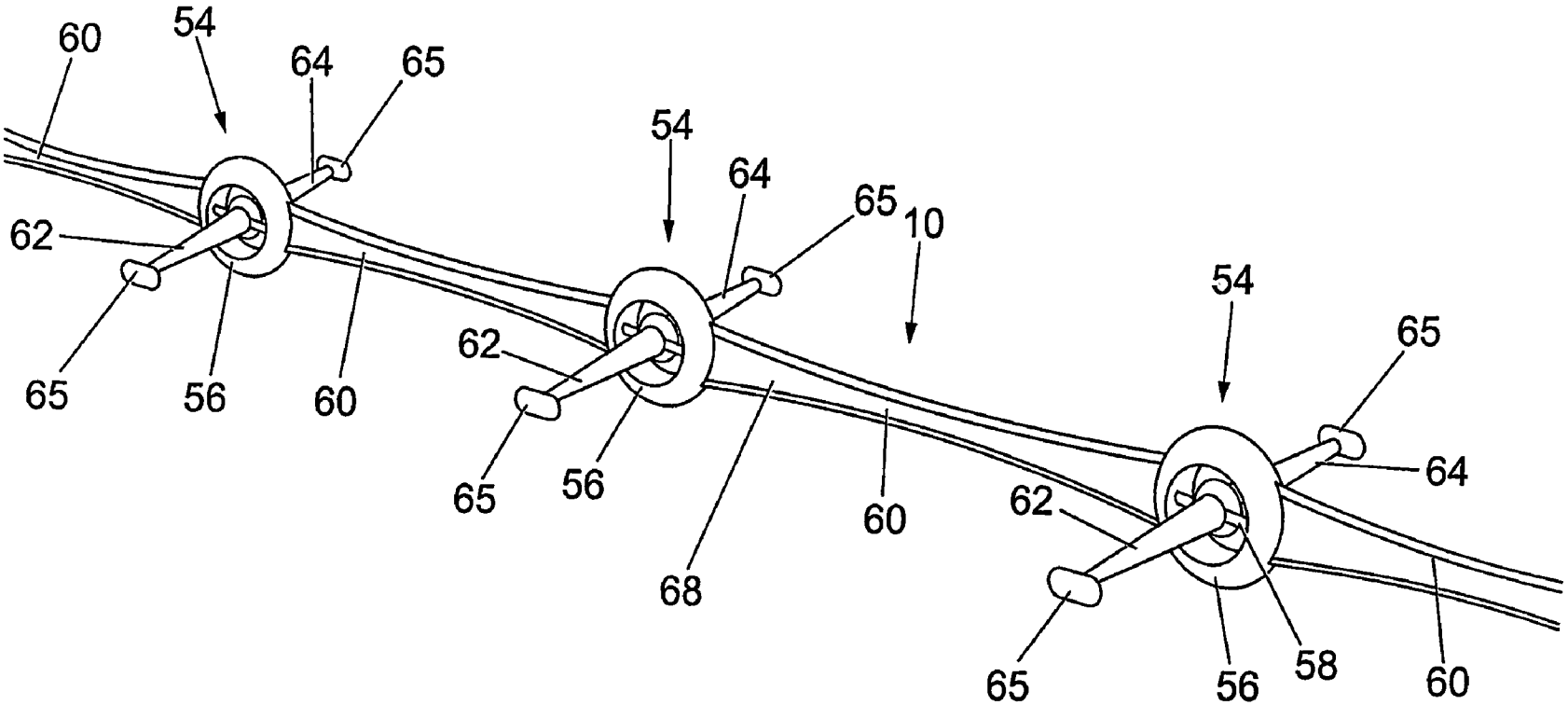
FIG. 6 is a perspective view of one embodiment of the apparatus.

FIG. 6 shows an embodiment of apparatus 10, having spine members 60 connected to each other by single pivot nodes 54. The spine members typically comprise an elongate strip covered with a non-pvc rubber. The spine members 60 can typically comprise thin sheets of plastic, metal or composite material (such as GRP or carbon fibre), orientated so that in use the sheets lie in the vertical plane. This allows lateral but not vertical flexibility of the spine members.

In this embodiment, each node 54 comprises a ring 56 and a rod 58, which passes through the centre of the ring 56 in a direction parallel to the axis of the spine members 60. Each pair of arms 62, 64 is typically formed as a single piece, having a central bore arranged parallel to the axis of the spine members 60 and shaped to accommodate the rod 58, which passes through the bore. Each pair of arms 62, 64 is pivotal around the rod 58 and is thus pivotable with respect to the spine members 60, but the arms 62, 64 are not pivotable with respect to each other. The ends of arms 62, 64 have elongate tabs 65 to engage in the sockets of the harness. Spine members 60 optionally have reflectors 68, which help the children 12 to be seen in the dark.

Figure 7:
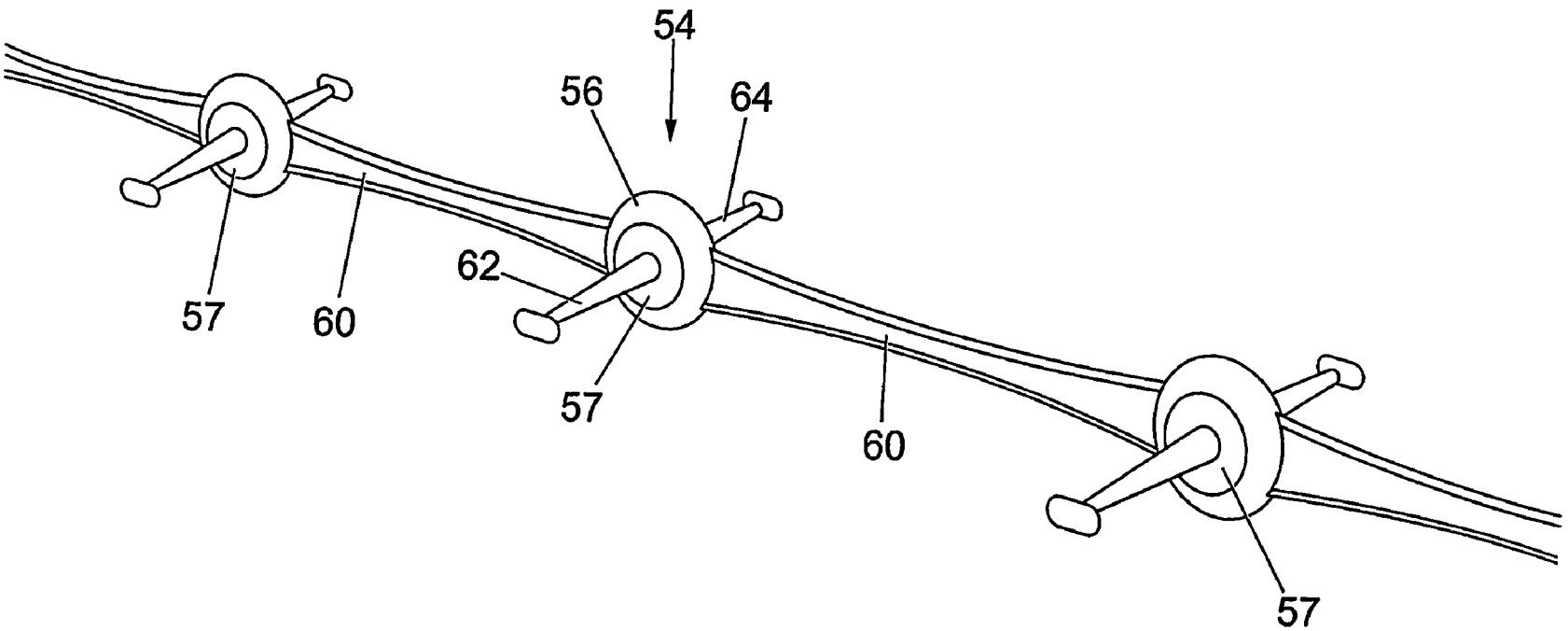
FIG. 7 is a perspective view of an alternative embodiment of the apparatus.

FIG. 7 shows an embodiment very similar to that of FIG. 6, except that the rings 56 of each node 54 are closed or covered, typically by a rubber or plastics gaiter. This could help prevent fingers from becoming trapped in the nodes 54. In this embodiment the arms 62, 64 could be pivotable independently of one another.

Figure 8:
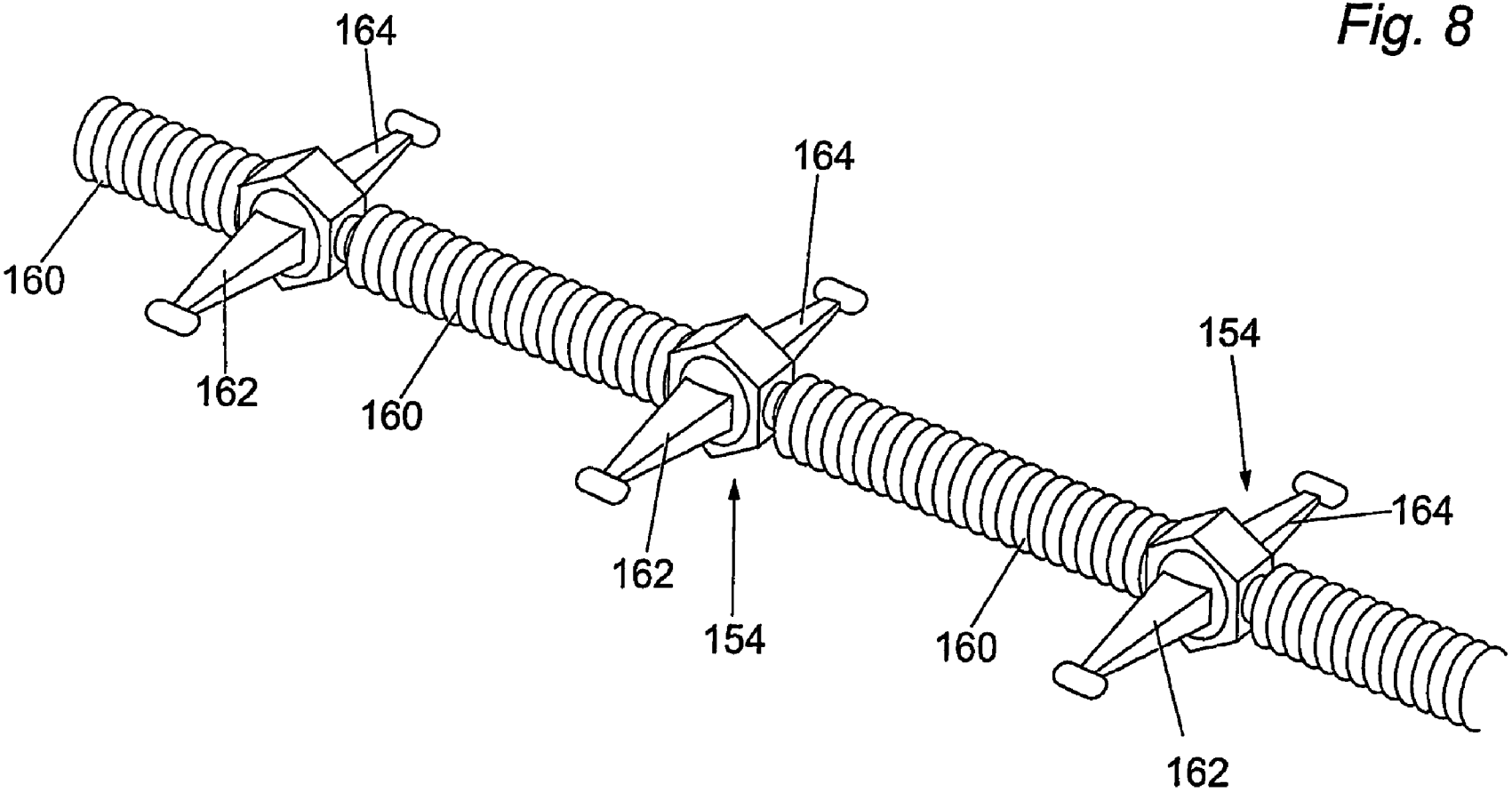
FIG. 8 is a perspective view of an alternative embodiment of the apparatus.

FIG. 8 shows an alternative embodiment of apparatus 110, having a number of spine members 160, each of which includes a portion of corrugated plastic tubing. The corrugated tubing allows the spine members 160 to bend laterally and to be compressed and stretched axially. The other major difference from the previous embodiment is that the arms 162, 164 are pivotable relative to each other, as well as relative to nodes 154. The arms 162, 164 are also typically resilient and can be formed from a rubber material. These arms could of course be used with the earlier embodiments.

Figure 9:
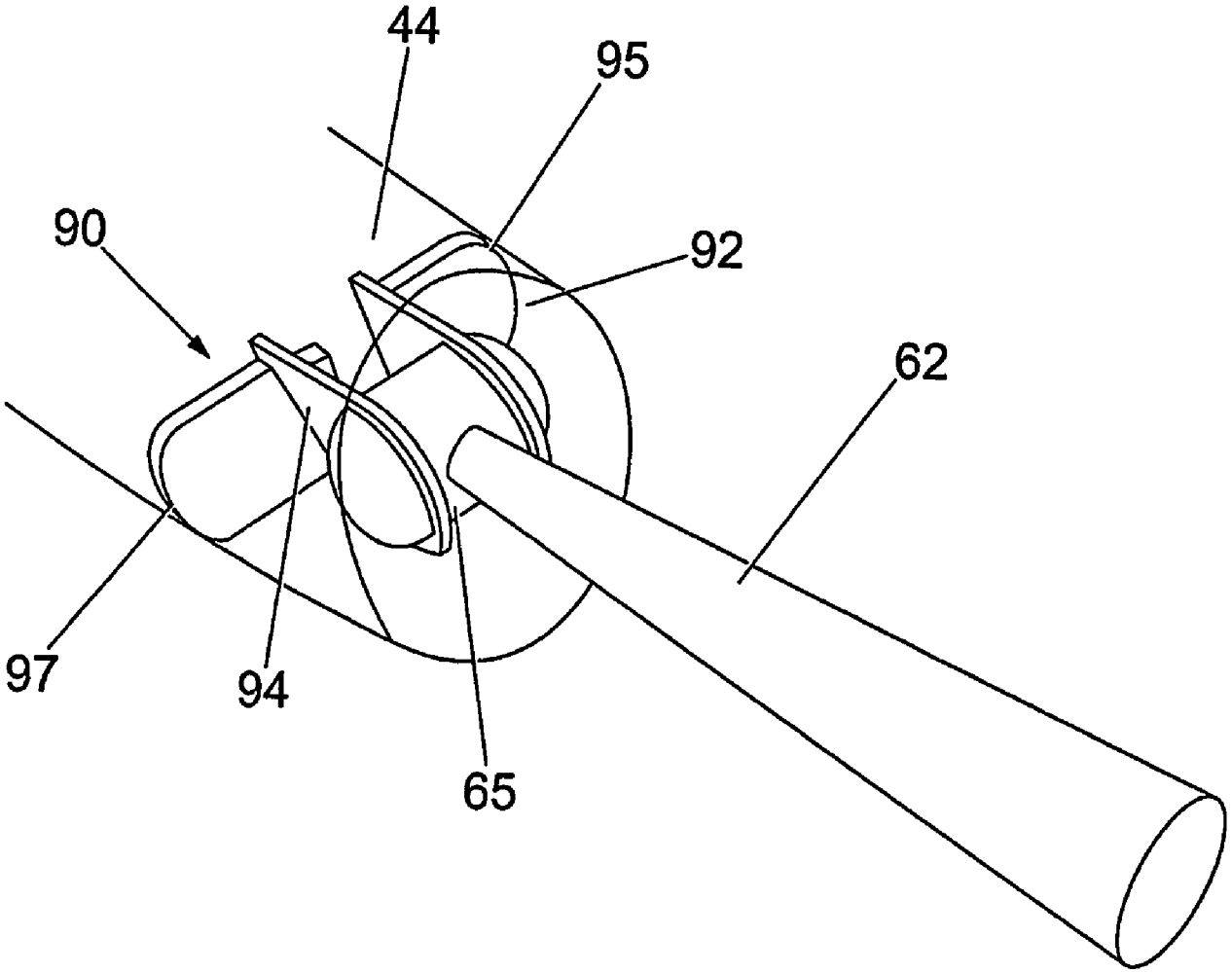
FIG. 9 is a perspective view with interior detail of part of the apparatus, showing an arm located in a socket.
Figure 10:
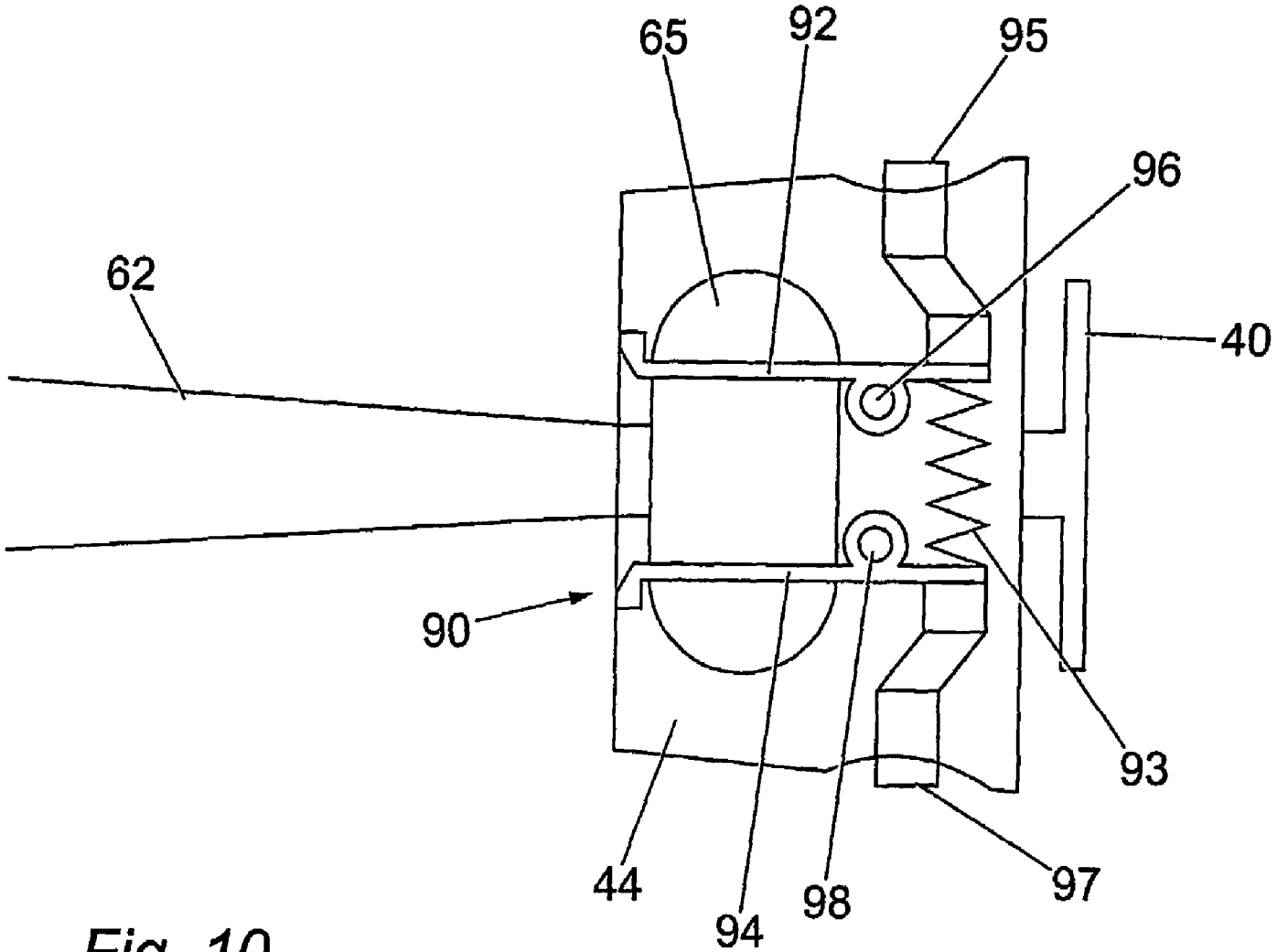
FIG. 10 is a side view with interior detail of the arm and socket of FIG. 9.

FIGS. 9 and 10 show views of arm 62 engaged in socket 44. Inside socket 44 is a grip device 90, which includes two plates 92, 94, each having an aperture to receive opposite ends of elongate tab 65 on the end of the arm 62. The plates 92, 94 are pivotable about respective pivot points 96, 98 and a coil spring 93 held in compression between the plates on one side of the pivot points 96, 98 at the end furthest from the socket mouth urges the other ends of the plates together to capture the tab 65 in the apertures. Dual buttons 95, 97 are connected to the plate ends above and below the spring 93.

The dual buttons enable release from the apparatus.

Simpler connectors are possible, along the lines of buckles or clips conventionally used with backpacks and webbing straps, and any connector to secure the child to the arm can be used.

Figure 11:
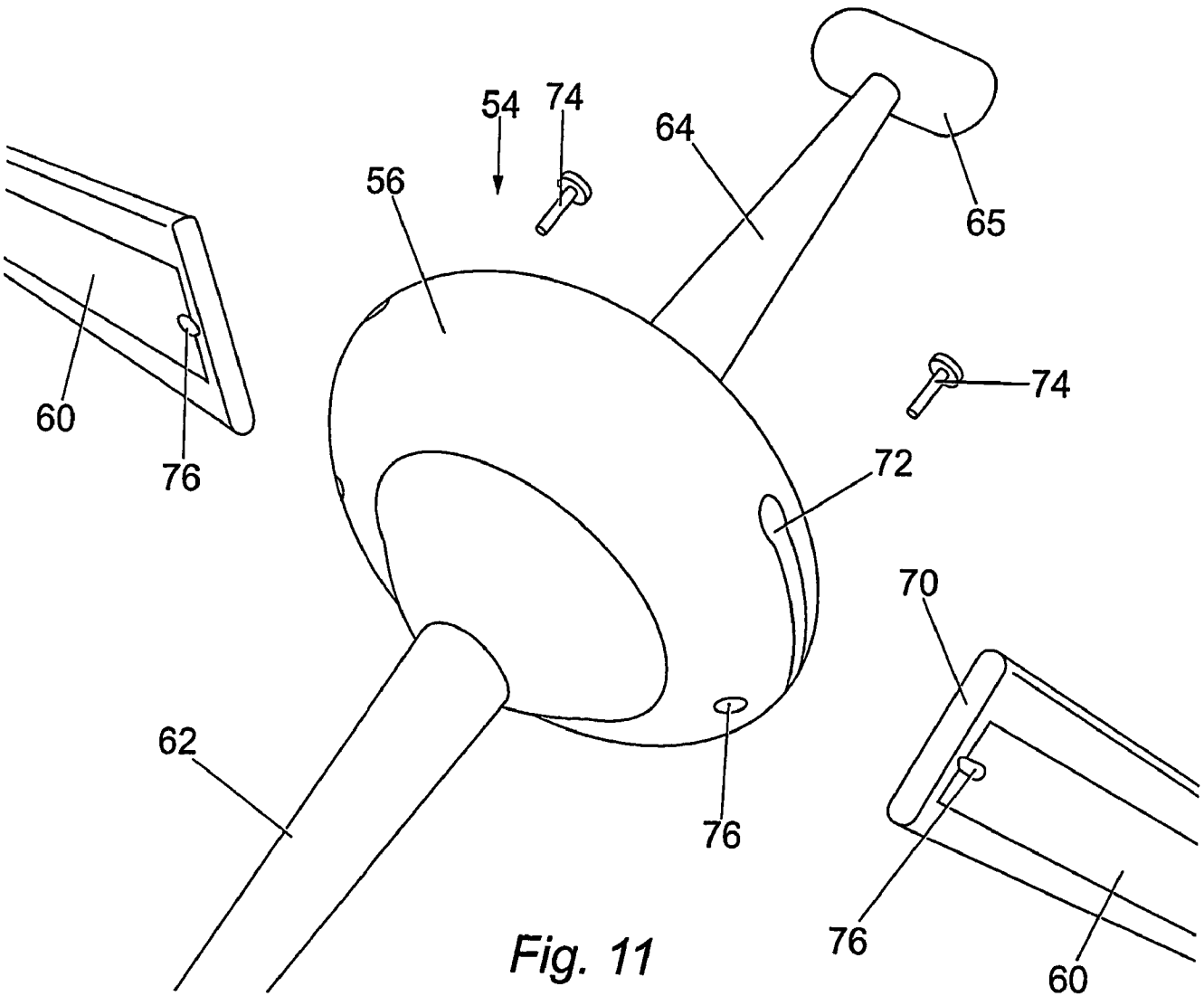
FIG. 11 is an exploded view of a node, spine members and attachment means.
Figure 12:
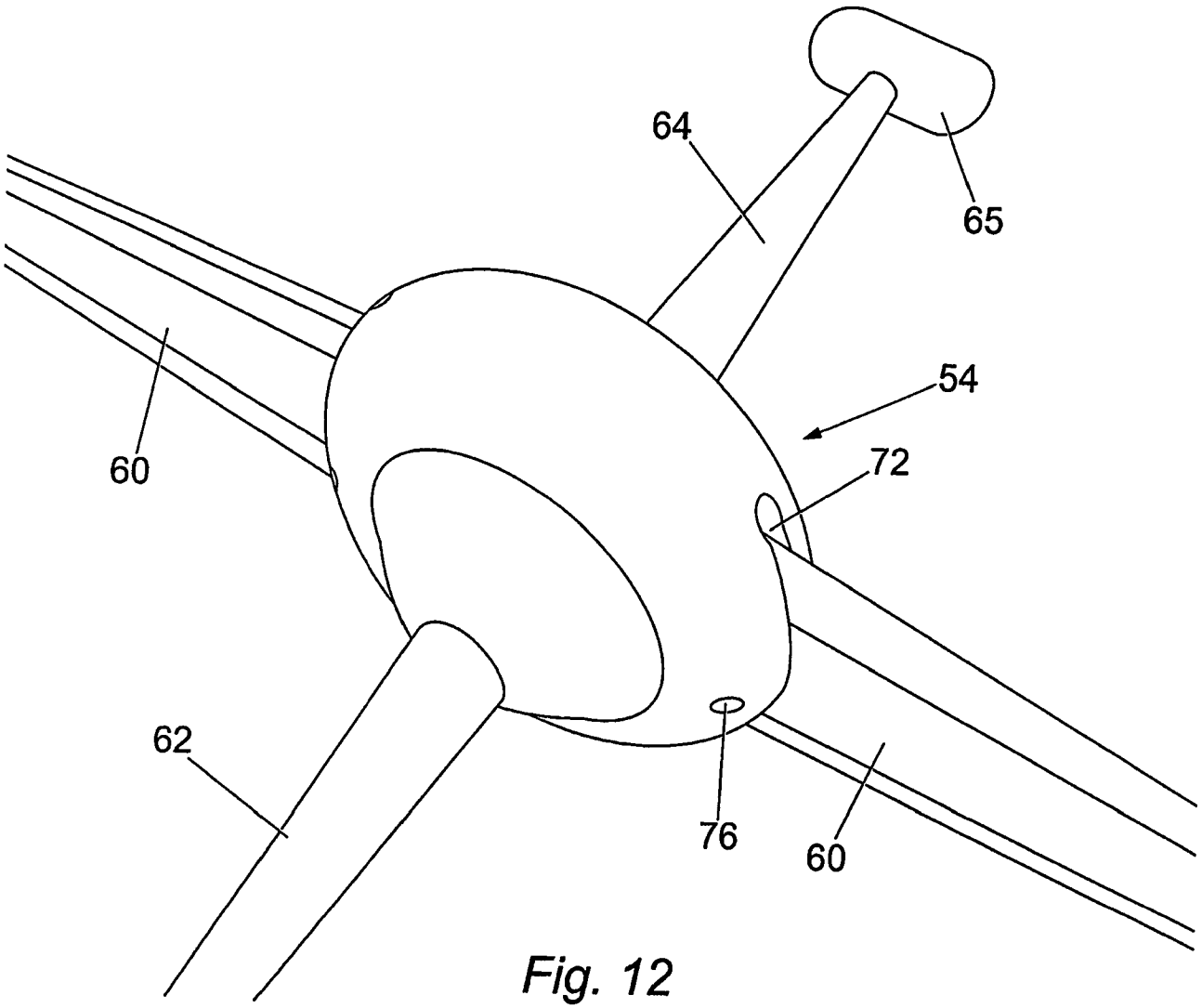
FIG. 12 is a perspective view of the apparatus of FIG. 11 with the node secured to the spine members.

FIGS. 11 to 14 show details of possible connections between nodes 54 and spine members 60. FIG. 11 is an exploded view showing spine members 60, the ends of which terminate in rods that can slide into vertical slots 72 in nodes 54 and are secured therein by bolts 74 or pins. Bolts 74 fit through a first aperture 76 in one side of ring 56, a corresponding aperture 70 in the end of each spine member 60 and through a second aperture 76 in ring 56. FIG. 12 is a non-exploded view of FIG. 11.

Figure 13:
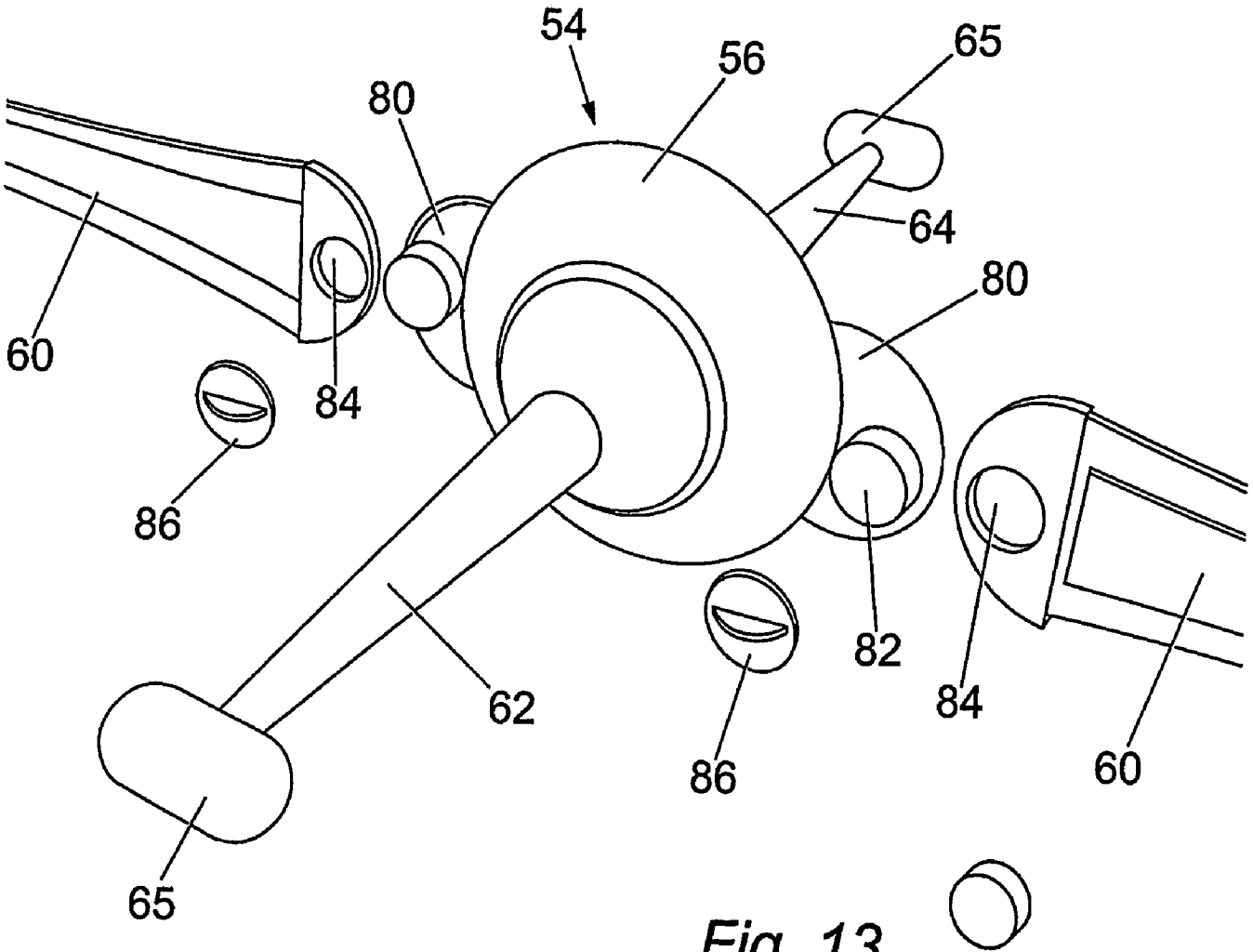
FIG. 13 is an exploded view of a node of the apparatus, spine members and an alternative attachment means.
Figure 14:
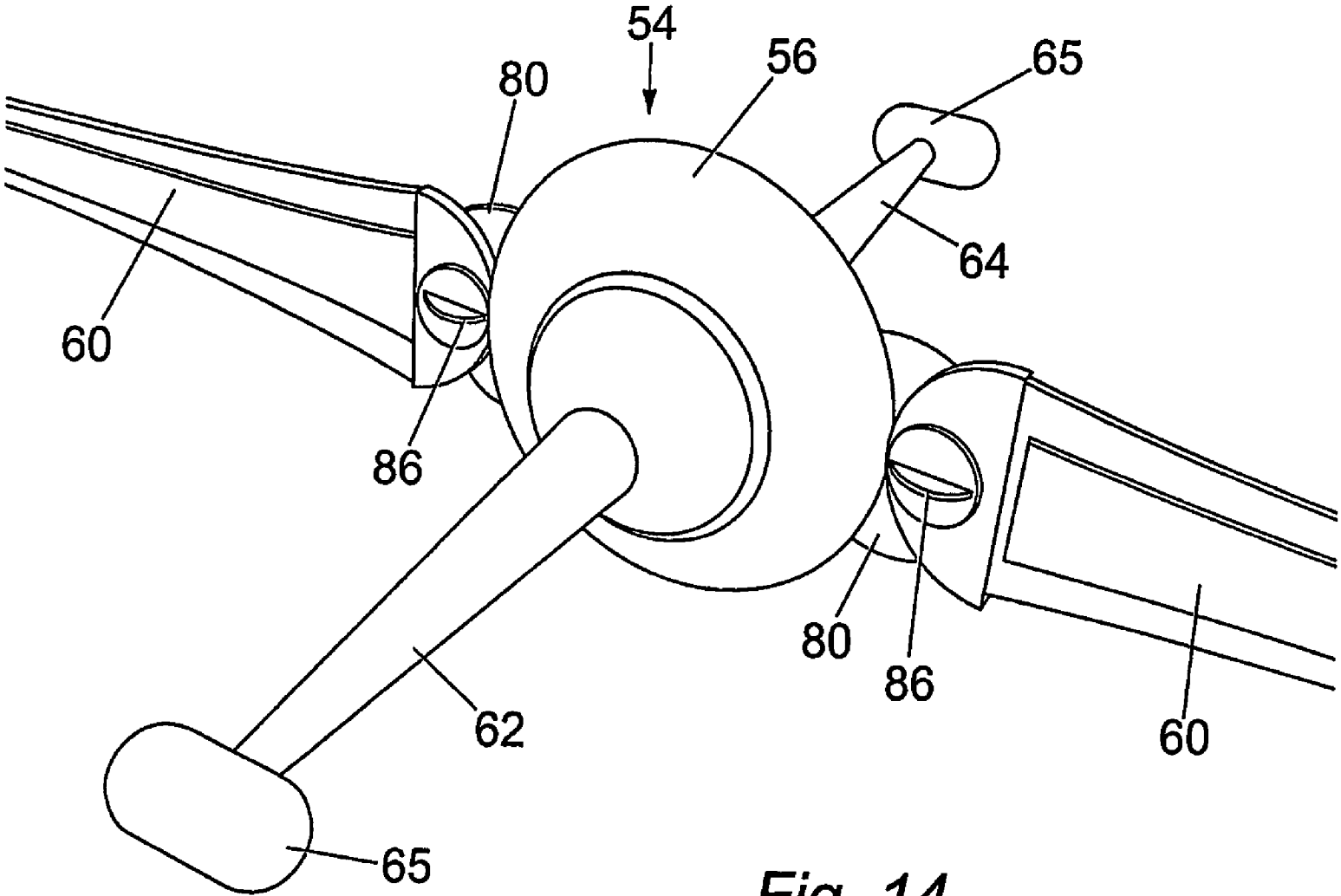
FIG. 14 is a perspective view of the apparatus of FIG. 13 with the node secured to the spine members.
Figure 15A:
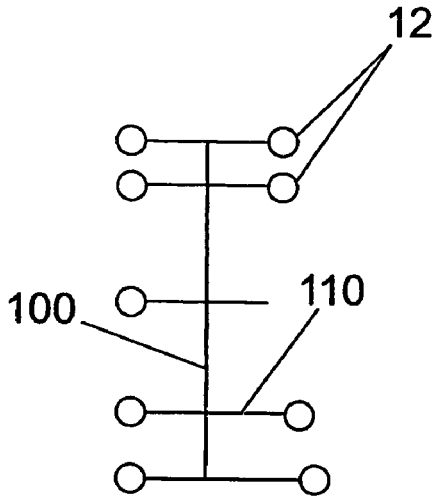
FIGS. 15*a*-15*d* show schematic views of different embodiments of the apparatus.
Figure 15B:
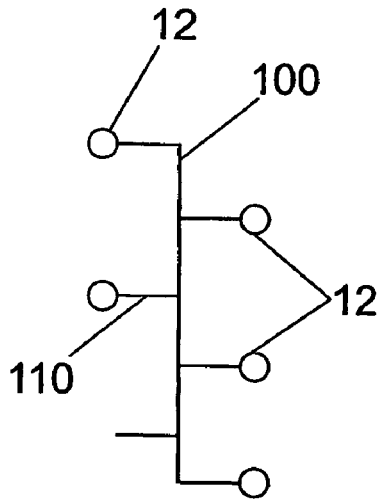
Figure 15C:
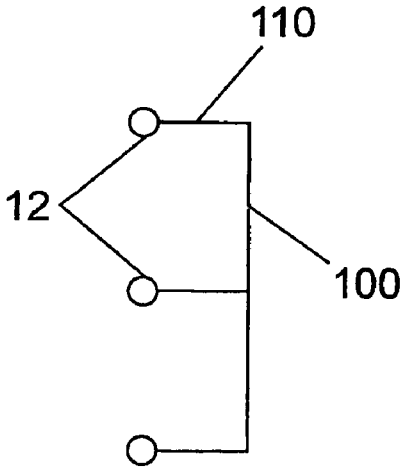
Figure 15D:
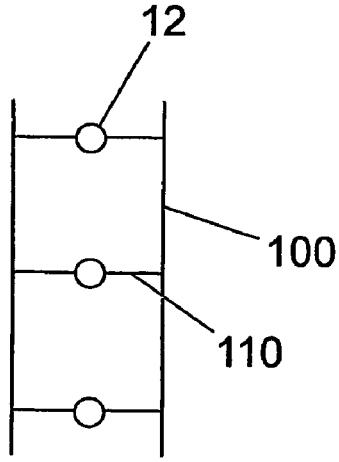

FIG. 13 shows an alternative connection between nodes 54 and spine members 60. Ring 54 has two end lobes 80, which each have a cylindrical lateral protrusion 82 in one side. The protrusions 82 are shaped to engage sockets 84 in the ends of spine members 60. Securing caps 86 attach to the protrusions 82 once they are engaged in sockets 84. The caps 86 are typically screwed to the protrusions by engaging interior screw threads of the cap 86 with exterior screw threads on the protrusion 82, but other engagement means could also be used. FIG. 14 is a non-exploded view of FIG. 13.

To secure a child to the restraining apparatus 10, the child 12 puts on a harness 36 and fastens the belt buckle 42. One of the sockets 44 of the harness 36 is then connected to an arm 24 of the apparatus 10. This is done by simultaneously pushing socket buttons 95, 97. This compresses the spring 93 and pivots the plates 92, 94 so the ends of the plates 92, 94 at the socket opening move away from each other. This widens the socket entrance enough to allow the elongate tab 65 to be inserted. Once the tab 65 is aligned with the apertures in the plates 92, 94, the buttons 95, 97 are released, which moves the plate ends over the tab 65, leaving the ends of the tab 65 projecting through the apertures in the plates 92, 94. Thus, the elongate tab 65 is trapped in the socket 44 and the child 12 is secured to apparatus 10. The procedure is repeated to secure all the children required to respective arms of the apparatus 10.

To disengage a child 12 from the apparatus 10, the socket buttons 95, 97, are simultaneously compressed and held down. This compresses spring 93, and pivots the plates 92, 94 to widen the socket opening as before. This releases the tab 65 from the apertures in the plates 92, 94 and the arm 62 is then pulled out of the socket 44. The buttons 95, 97 are now released and the child takes off the harness 36. This procedure is repeated to release all children 12 from the apparatus 10.

Modifications and improvements can be incorporated without departing from the scope of the invention. For example, the position of the tabs and sockets could be reversed, i.e. each arm could have a socket and the harness could have a tab to engage the socket.

The arm and socket do not have to engage by apertures in plates engaging the arms; any way of attaching the arm to the socket would be adequate, e.g. the arm could screw into the socket.

The socket could be replaced by a lock mechanism, requiring a special tool to release the arm, so that a child secured to the apparatus could not release itself.

Two sets of apparatus could be used parallel to each other, with a central column of children attached to both apparatus. FIG. 15 shows a number of different schematic combinations of children 12, spines 100 and arms 110. Not all of the nodes need to be provided with arms at each side, nor do all the nodes or arms need to be occupied by children.

Embodiments of the invention could be created using a single spine instead of separate spine members (thereby removing the need for nodes) where the arms extend out through apertures in the spine. The harnesses could be permanently attached to the apparatus (instead of releasably attached by the arm and socket connection).

The invention claimed is:

1. Restraining-apparatus for coupling at least two users comprising at least one spine member with first and second nodes connected to the spine member at opposite ends of the spine member, each of the first and second nodes having first and second ends, and having connection devices for connecting and disconnecting a respective spine member at each end of the node, each node having at least one lateral attachment member releasably coupled to each node, each lateral attachment member being adapted to couple a respective user to a node of the spine member, the spine member having a first vertical plane, and a second lateral plane, the spine member having a stiffening member to enhance rigidity in said first vertical plane, whereby the spine member is rigid in said vertical plane but wherein the spine member has a higher degree of flexibility in said lateral plane than in said vertical plane, the apparatus having a releasable fastener device for coupling each user to a respective attachment member, wherein each releasable fastener device is coupled to a respective lateral attachment member on each of the nodes.

2. Apparatus as claimed in claim 1, where each spine member is an elongate member selected from the group consisting of a rod and a plate-from which the lateral attachment members extend sideways from each side of each spine member.

3. Apparatus as claimed in claim 1, wherein each spine member is inextensible along its long axis.

4. Apparatus as claimed in claim 1, wherein each spine member has a degree of lateral resilience.

5. Apparatus as claimed in claim 1, wherein each spine member is at least partially formed from a material selected from the group comprising plastics material, composite material, and resilient materials.

6. Apparatus as claimed in claim 1, wherein the stiffening member is at least partially formed from a material selected from the group consisting of plastics, metals and composite materials.

7. Apparatus as claimed in claim 1, wherein the attachment members comprise elongate arms extending laterally from each spine member.

8. Apparatus as claimed in claim 1, wherein the arms have properties selected from the group consisting of flexibility, axial extensibility, and compressibility.

9. Apparatus as claimed in claim 1, wherein the attachment members are rigid, and wherein respective attachment members extend from different sides of the spine member.

10. Apparatus as claimed in claim 1, wherein attachment members are staggered along the spine member.

11. Apparatus as claimed in claim 1, including harnesses worn by each user and wherein the attachment members are adapted to attach to the harnesses.

12. Apparatus as claimed in claim 11, wherein the attachment members are adapted to attach releasably to the harnesses.

13. Apparatus as claimed in claim 1, incorporating luminous, reflective and/or light emitting devices.

14. Restraining apparatus as claimed in claim 1, wherein the releasable fastener comprises a male portion with a projecting part, and a female portion with a socket, wherein the projecting part of the male portion couples with the socket on the female portion, thereby releasably fastening the two portions together.

15. Restraining apparatus as claimed in claim 14, wherein the releasable fastener comprises a resilient locking device resisting disconnection of the two portions from one another.

16. Restraining apparatus for coupling at least two users comprising at least one spine member with at least two lateral attachment members adapted to couple respective first and second users to the spine member, the spine member having a first vertical plane, and a second lateral plane, the spine member having a stiffening member to enhance rigidity in said first vertical plane, whereby the spine member is rigid in said vertical plane but wherein the spine member has a higher degree of flexibility in said lateral plane than in said vertical plane, the apparatus having a releasable fastener device for coupling each user to a respective attachment member, wherein the attachment members comprise elongate arms extending laterally from the spine member and releasably secured thereto, and wherein each arm is adapted to rotate around an axis passing through the spine member.

17. Apparatus as claimed in claim 16, wherein at least two arms are provided and said at least two arms are pivotable with respect to each other.

18. A method of securing or restraining at least two users together, comprising harnessing each of the users to a common spine member via an respective attachment member, the apparatus having a releasable fastener device for coupling each user to a respective attachment member, the spine member having first and second nodes connected to the spine member at opposite ends of the spine member, each of the first and second nodes having first and second ends, and having connection devices for connecting and disconnecting a respective spine member at each end of the node, each node having at least one attachment member releasably coupled to each node, each attachment member being adapted to couple a respective user to a node of the spine member, each spine member having a first vertical plane, and a second lateral plane, and a stiffening member to enhance rigidity in said first vertical plane, whereby each spine member is rigid in said vertical plane but wherein each spine member has a higher degree of flexibility in said lateral plane than in said vertical plane, and wherein each user is harnessed to a respective attachment member via the releasable fastener device.

* * * * *